US007481521B2

(12) United States Patent
Takemoto

(10) Patent No.: US 7,481,521 B2
(45) Date of Patent: Jan. 27, 2009

(54) AIR REMOVAL DEVICE FOR INK SUPPLY MECHANISM, INK SUPPLY MECHANISM, AND INK-JET PRINTER

(75) Inventor: Takatoshi Takemoto, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 332 days.

(21) Appl. No.: 11/512,687

(22) Filed: Aug. 30, 2006

(65) Prior Publication Data

US 2007/0046747 A1 Mar. 1, 2007

(30) Foreign Application Priority Data

Aug. 31, 2005 (JP) ..... 2005-251779

(51) Int. Cl.
*B41J 2/19* (2006.01)
*B41J 2/175* (2006.01)

(52) U.S. Cl. ..... 347/92; 347/85

(58) Field of Classification Search ..... 347/84, 347/85, 86, 87, 92
See application file for complete search history.

(56) References Cited

U.S. PATENT DOCUMENTS 6,540,321 B1 4/2003 Hirano et al.
6,637,872 B2 * 10/2003 Ara et al. ..... 347/85
6,755,500 B2 6/2004 Hirano et al.
7,198,342 B2 * 4/2007 Mizoguchi ..... 347/7
7,261,402 B2 * 8/2007 Taniguchi et al. ..... 347/86
7,318,639 B2 * 1/2008 Udagawa ..... 347/85

FOREIGN PATENT DOCUMENTS

| | | |
|---|---|---|
| JP | 2000-334982 | 12/2000 |
| JP | 2001-301194 | 10/2001 |
| JP | 2002192743 | 7/2002 |
| JP | 2002200773 | 7/2002 |
| JP | 2002200774 | 7/2002 |

* cited by examiner

*Primary Examiner*—Anh T. N. Vo
(74) *Attorney, Agent, or Firm*—Reed Smith LLP

(57) ABSTRACT

An air removal device for ink supply mechanism is provided which ensures separation of ink from an air permeable membrane after removal of air is completed. The air removal device includes an ink chamber, an air discharge passage, an air permeable membrane, a pump, and a movable member. The movable member is designed to be displaced between a first position and a second position. When the movable member is displaced to the second position to operate the pump, air collected in the ink chamber is discharged to the air discharge passage. When the pump is stopped and the movable member is displaced to the first position, one or both of air left in a portion of space in the ink chamber and air present downstream in an air discharge direction of the air permeable membrane flows in between the air permeable membrane and the ink inside the ink chamber.

12 Claims, 10 Drawing Sheets

AIR REMOVAL DEVICE FOR INK SUPPLY MECHANISM, INK SUPPLY MECHANISM, AND INK-JET PRINTER

CROSS-REFERENCE TO RELATED APPLICATIONS

This application claims the benefit of Japanese Patent Application No. 2005-251779 filed Aug. 31, 2005 in the Japan Patent Office, the disclosure of which is incorporated herein by reference.

BACKGROUND

This invention relates to an air removal device which is used to remove bubbles mixed in ink flowing through an ink passage in an ink supply mechanism mounted on an ink-jet printer, the ink supply mechanism provided with the air removal device, and the ink-jet printer.

A conventionally known air removal device for ink supply mechanism, for example, includes an ink chamber in an ink passage from an ink supply source to a recording head. When bubbles (air) mixed in ink flowing through the ink passage are collected to the upper part of the ink chamber, the collected air is discharged to the outside via an air discharge passage.

In the vicinity of an entrance to the air discharge passage, an air permeable membrane is provided which passes air but not ink. When a positive pressure to the ink chamber side or a negative pressure to the air discharge passage side is applied by a pump, the air collected in the upper part of the ink chamber passes through the air permeable membrane to flow from the ink chamber to the air discharge passage. When ink flows into the ink chamber from upstream of the ink passage as the air in the upper part of the ink chamber is discharged, ink and the air permeable membrane are brought into contact with each other in the end. As a result, there is no more permeation of air from the ink chamber to the air discharge passage. Thus, removal of air is complete.

SUMMARY

However, in an air removal device as above, if ink is left in contact with the air permeable membrane after removal of air is completed, the ink may soak into the air permeable membrane and permeation of air is hindered. As a result, there is a problem that performance of the air permeable membrane may deteriorate.

The present invention is made to solve the above problem. It would be desirable to provide an air removal device for ink supply mechanism, which can ensure separation of ink from an air permeable membrane after completion of air removal. It would be also desirable to provide an ink supply mechanism provided with such an air removal device, and an ink-jet printer provided with the ink supply mechanism.

It is desirable that an air removal device for ink supply mechanism of the present invention includes an ink chamber that is provided in an ink passage from an ink supply source to a recording head; an air discharge passage that is provided to discharge, out of the ink chamber, air flowing into the ink chamber with ink and collected therein; an air permeable membrane that is provided at an entrance or inside of the air discharge passage to pass air but not ink; a pump that applies a positive pressure to the ink chamber side or a negative pressure to the air discharge passage side in order to discharge air via the air discharge passage; and a movable member that has an internal cavity functioning as a part of the air discharge passage and is displaced between a first position and a second position. The movable member is displaced to the first position except when air is discharged via the air discharge passage. The movable member is displaced to the second position when air is discharged via the air discharge passage. When the movable member is displaced to the second position to operate the pump, air is discharged from the ink chamber to the air discharge passage. The ink inside the ink chamber comes into contact with the air permeable membrane while air is still left in a portion of space inside the ink chamber. When the pump is then stopped and the movable member is displaced to the first position, one or both of air left in the portion of space and air present downstream in an air discharge direction of the air permeable membrane flows in between the air permeable membrane and the ink inside the ink chamber, so that the ink inside the ink chamber is separated from the air permeable membrane.

According to the above air removal device for ink supply mechanism, performance of the air permeable membrane can be maintained for a longer term than an air removal device in which ink is left in contact with the air permeable membrane.

BRIEF DESCRIPTION OF THE DRAWINGS

The invention will now be described below, by way of example, with reference to the accompanying drawings, in which:

FIGS. 5A and 53 are longitudinal sectional views showing a structure of an actuator for driving the movable member and the periphery;

DETAILED DESCRIPTION OF THE PREFERRED EMBODIMENT

1 First Embodiment

Hereinafter explained is a multi function apparatus including a printer function, a scanner function, a copying function, and a facsimile function. An ink-jet printer having distinguishing features of the present inventions is adopted as an image recorder of this multi function apparatus.

1.1 Structure of Multi Function Apparatus and Ink Supply Mechanism

Figure 1:
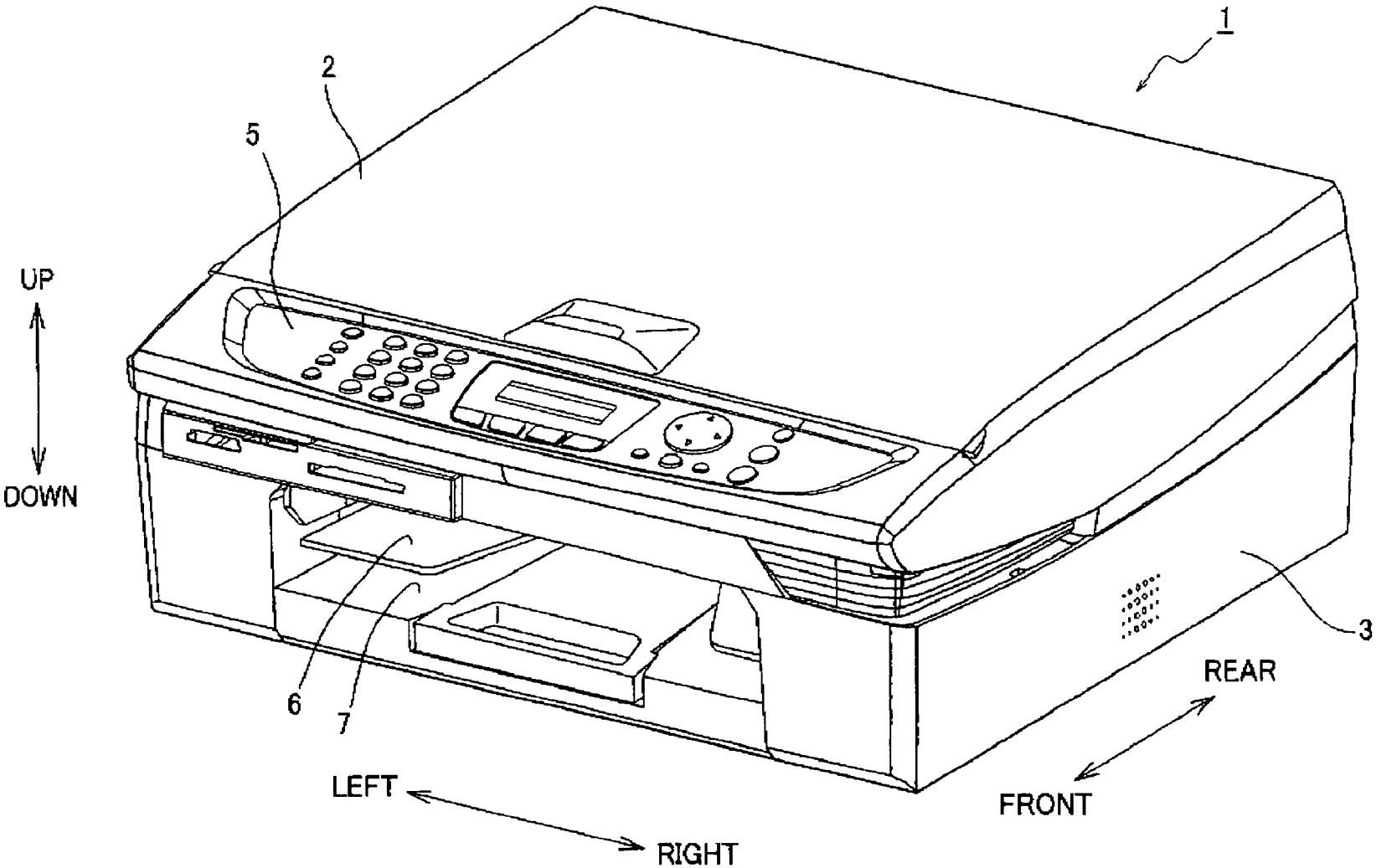
FIG. 1 is a perspective view showing external appearance of a multi function apparatus.

Referring to FIG. 1, a multi function apparatus 1 is provided with a flat bed image reader 2 on its upper part, and an image recorder 3 on its lower part. An operation panel 5 is disposed at the front end on the upper part of the apparatus 1, A feed cassette 7 having a discharge tray 6 is detachably inserted to an opening provided at the lower part of the front side of the apparatus 1.

Figure 2:
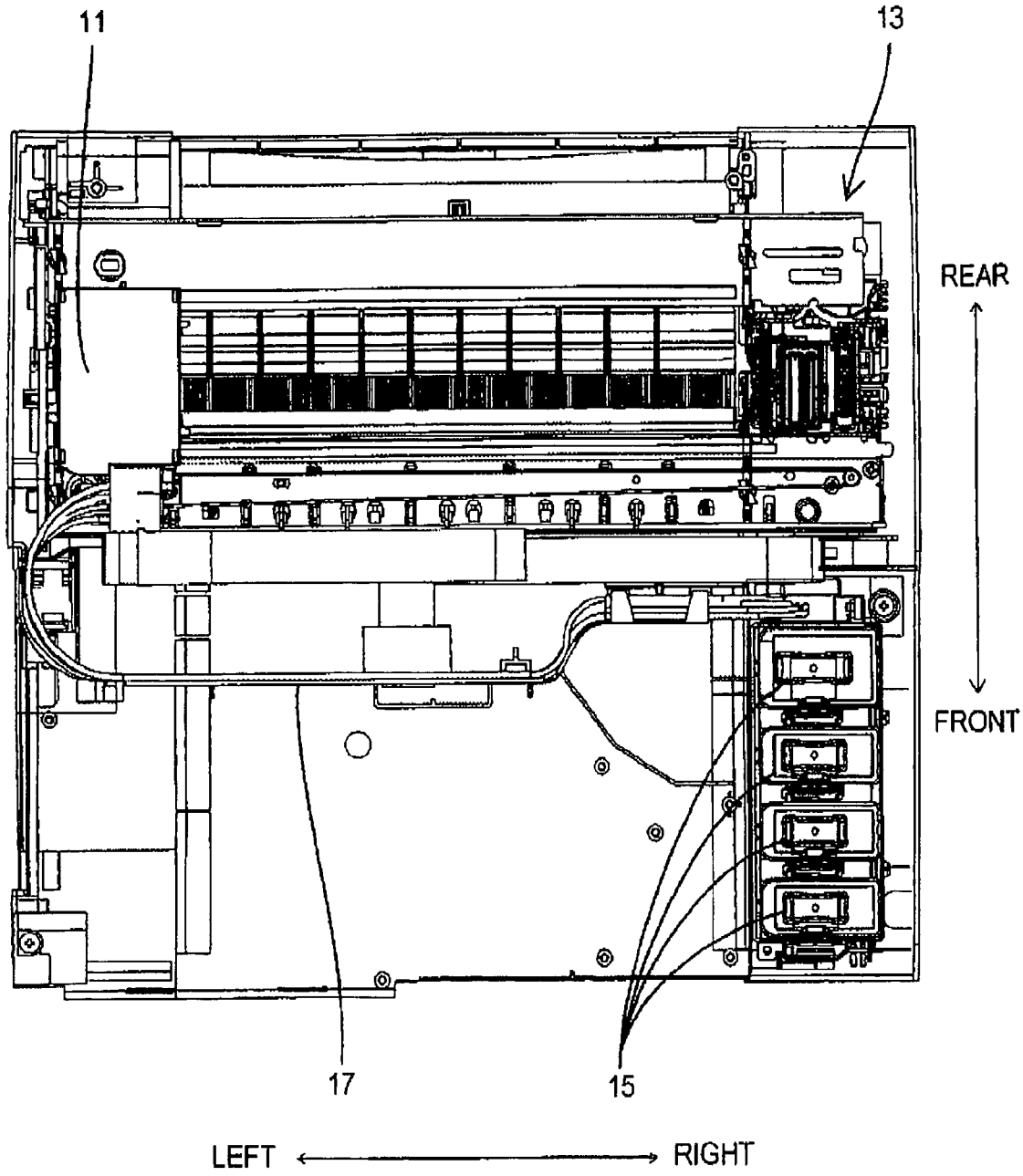
FIG. 2 is a plan view showing an internal structure of an image recorder.

Referring to FIG. 2, the image recorder 3 is provided with a carriage 11 which can reciprocate in a horizontal direction. A maintenance unit 13 is provided at the rightmost end of a movable range of the carriage 11. Hereinafter, the rightmost end of the movable range of the carriage 11 is referred to as a maintenance position.

Four ink cartridges 15 for ink of four colors, that is, black, cyan, magenta and yellow, are installed in front of the maintenance unit 13. The ink cartridges 15 are supply sources of four colors of ink. Ink tubes 17 are provided between the respective ink cartridges 15 and the carriage 11. Ink is supplied from the ink cartridges 15 to the carriage 11 via the ink tubes 17.

Figure 3:
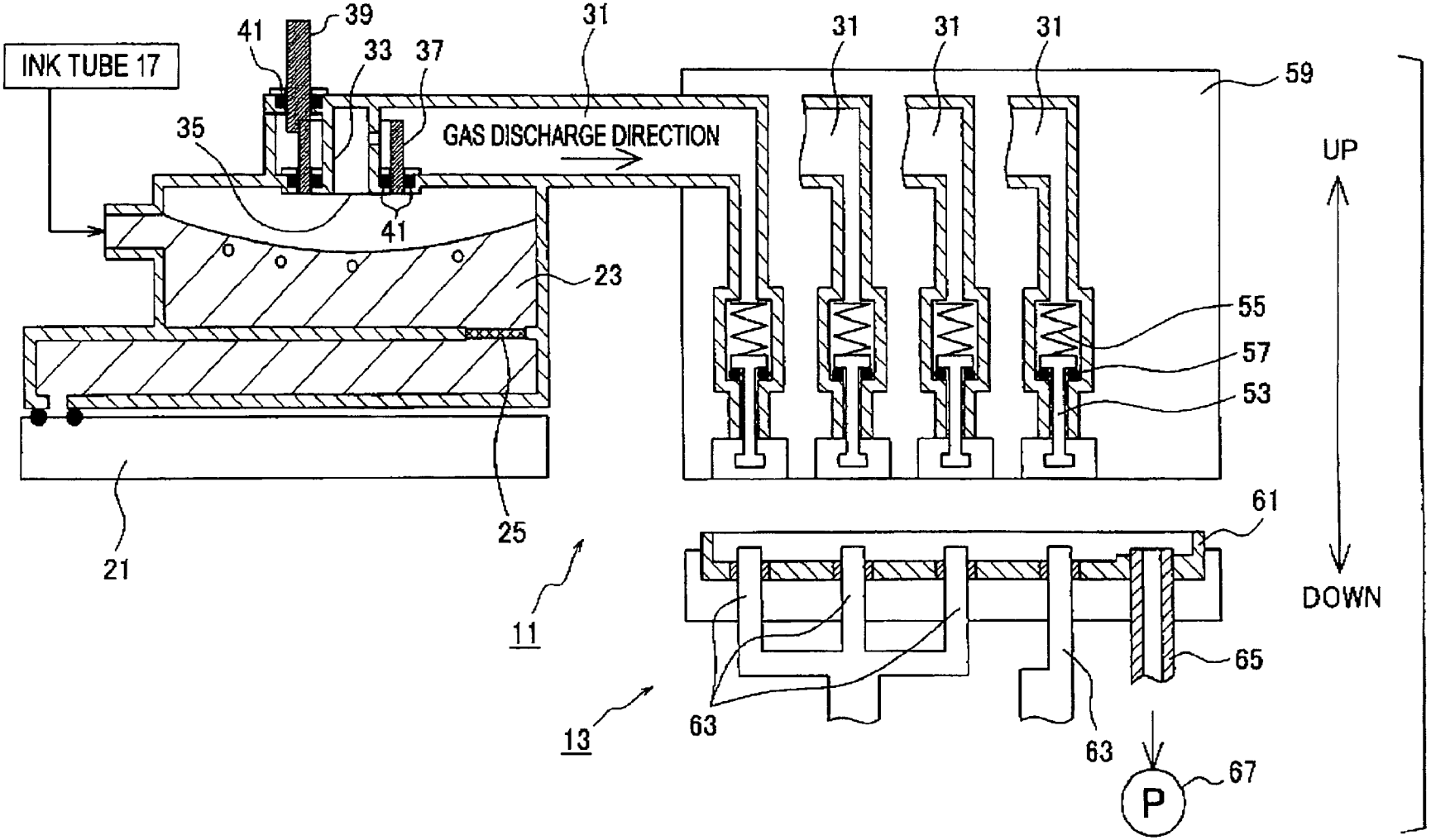
FIG. 3 is a schematic view mainly showing a structure of a carriage and a periphery of a maintenance unit.

Referring to FIG. 3, the carriage 11 mounts an ink-jet recording head 21. Ink supplied from the ink tubes 17 side is fed to the recording head 21 by way of ink passages, each of which has an ink chamber 23. That is, an ink supply mechanism is provided which includes the ink cartridges 15, the ink tubes 17, the ink passages with the ink chambers 23, and the recording head 21.

A filter 26 that partitions the ink chamber 23 into an upper and a lower parts is provided inside the respective ink chambers 23 in order to prevent bubbles mixed in ink from reaching to the recording head 21. Ink supplied from the ink tube 17 side and flowing to the upper part of the ink chamber 23 is separated into ink and bubbles when passing the filter 25. Only ink passes the filter 25 and bubbles are left in the upper part of the ink chamber 23. The bubbles left will be gradually accumulated in the upper part of the ink chamber 23.

It should be noted that FIG. 3 shows only one of the ink passages from the ink tube 17 side to the recording head 21. In the actual multi function apparatus 1, however, there are four ink passages respectively corresponding to the aforementioned four colors of ink.

1.2 Structure of Air Removal Device

Now a structure of an air removal device of the present embodiment is described. The air removal device is designed to remove the air collected in the upper part of the ink chamber 23 provided in the aforementioned ink supply mechanism.

As shown in FIG. 3, the carriage 11 is provided with four air discharge passages 31 which correspond to the aforementioned four ink passages. Each of the air discharge passages 31 communicates with the ink chamber 23 provided with each of the aforementioned four ink passages.

FIG. 3 only illustrates a partial structure in which the leftmost air discharge passage 31 communicates with the ink chamber 23 (structure near the upstream end in an air discharge direction). Illustrations of the structure for the other three air discharge passages 31 are omitted since all the air discharge passages 31 have an identical structure.

Near the upstream end in the air discharge direction of the air discharge passage 31 is provided a tubular body 33 having an opening at the bottom and the side surface, respectively. The tubular body 33 has a cavity which serves as a part of the air discharge passage 31. An air permeable membrane 35 which passes air but not ink is provided at the bottom of the tubular body 33, A tubular movable member 37 is provided on the outer peripheral side of the tubular body 33. The movable member 37 is disposed coaxial to the tubular body 33. The movable member 37 is designed to move in a vertical direction. The movable member 37 is located at a raised position (hereinafter, referred to as a first position) shown in FIG. 3 and FIG. 4B, except when air is discharged via the air discharge passage 31. Only when air is discharged via the air discharge passage 31, the movable member 37 is displaced to a lowered position (hereinafter, referred to as a second position). When the movable member 37 is displaced to the second position, the cavity serves as a part of the air discharge passage 31, and the opening at the bottom of the movable member 37 serves as an entrance to the air discharge passage 31.

Figure 4B:
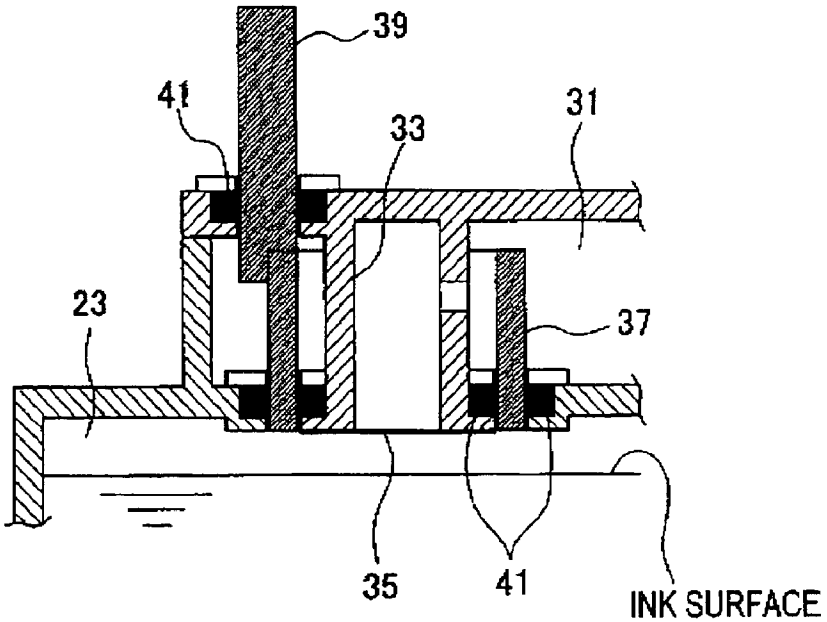
FIGS. 4A and 4B are longitudinal sectional views showing a structure of a movable member and the periphery according to a first embodiment.
Figure 4A:
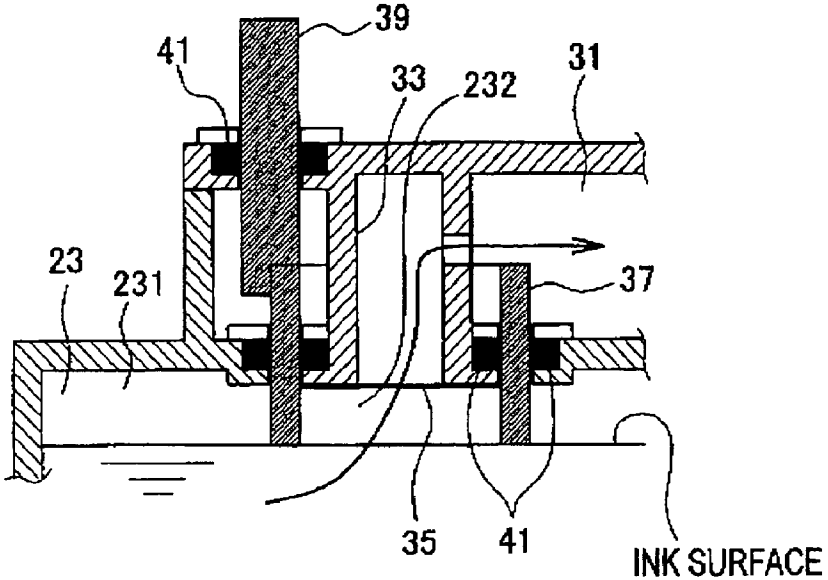

When the movable member 37 is displaced to the second position and a negative pressure is applied to the air discharge passage 31, air is discharged from the ink chamber 23 to the air discharge passage 31, as shown by an arrow in FIG. 4A. As the discharge of air is continued, a space 231 on the outer peripheral side of the movable member 37 is left with air, while ink is sucked up due to the negative pressure to fill up a space 232 on the inner peripheral side of the movable member 37. When the movable member 37 is displaced to the first position at this point, air left on the outer peripheral side of the movable member 37 flows into an area which has been on the inner peripheral side of the movable member 37. Since air flows in between the air permeable membrane 35 and the ink surface, as shown in FIG. 4B, the ink inside the ink chamber 23 becomes separated from the air permeable membrane 85, A rod 39 is provided to protrude on top of the movable member 37. Around each hole provided on wall of the air discharge passage 31 through which either the movable member 37 or the rod 39 passes, a seal member 41 is provided to ensure airtightness between the inside and the outside of the air discharge passage 31. When the movable member 37 is moved in a vertical direction, power from an actuator is transmitted to the movable member 37 via the rod 39.

Figure 5B:
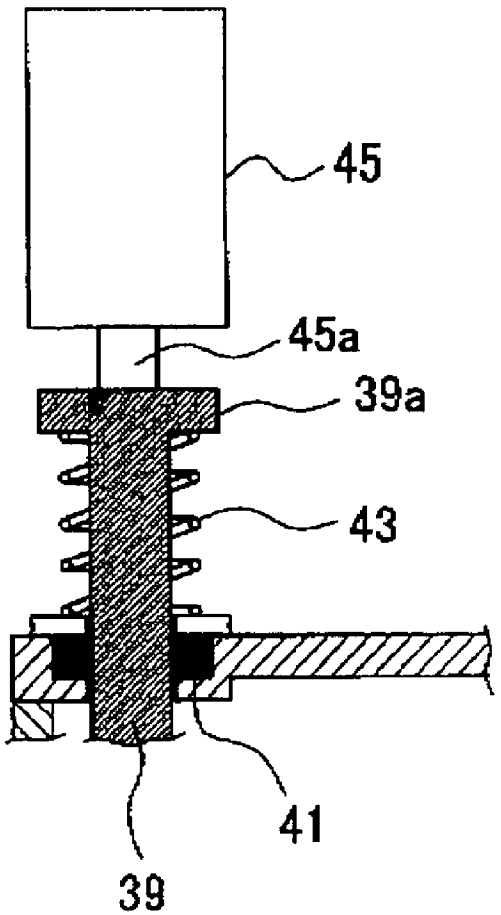
Figure 5A:
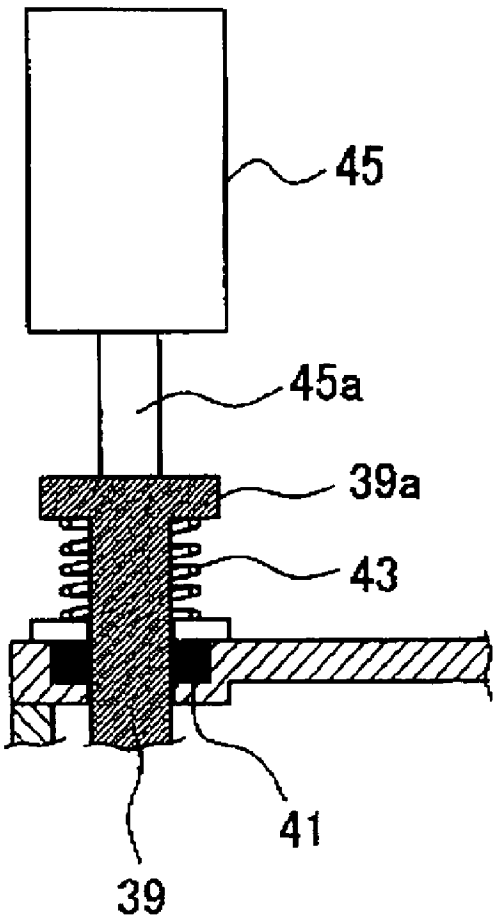
Figure 6:
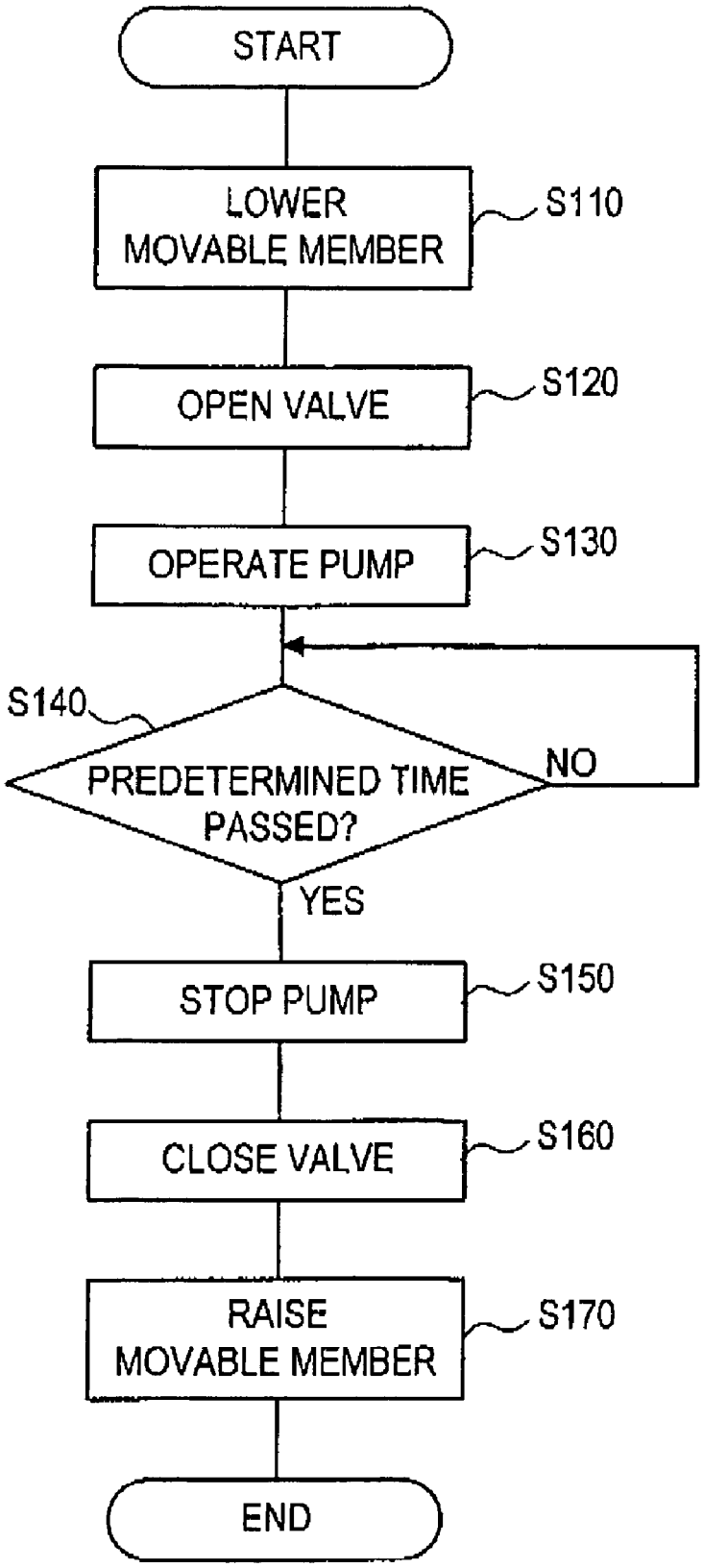
FIG. 6 is a flowchart of an air removal process.

A known actuator like a solenoid or a motor may be adopted as the actuator that moves up and down the movable member 37. For example, as shown in FIGS. 5A and 5B, a compression spring 43 which is compressed by a flange 39*a* formed on top of the rod 39 may be disposed on the outer circumference of the rod 39. In this case, when a solenoid 45 disposed above the rod 39 is energized, a plunger 45*a* of the solenoid 45 protrudes while compressing the compression spring 43 so as to lower the rod 39, as shown in FIG. 5A. When energization to the solenoid 45 is stopped, the rod 39 is raised due to recovery of the compression spring 43 which has been compressed, as shown in FIG. 5B.

Near the downstream end in the air discharge direction of the respective air discharge passages 31, there are provided a valve element 53, a spring 55, and a seal member 57, as shown in FIG. 3, which are installed inside a valve case 59. Each of the valve elements 53 is biased downward by the spring 55. When the valve element 53 is closely attached to the seal member 57 due to the biasing force, an exit from the air discharge passage 31 is closed.

The maintenance unit 13 includes a discharge cap 61, open/close members 63, and a discharge tube 65. When the carriage 11 moves to the aforementioned maintenance position, the top of the respective open/close members 63 face the bottom of the respective valve elements 53.

The discharge cap 61 can move in a vertical direction. When the discharge cap 61 is raised as the carriage 11 is moved to the aforementioned maintenance position, the discharge cap 61 comes into close contact with the valve case 59, so that an airtight space is formed between the bottom surface of the valve case 59 and the inner surface of the discharge cap 61.

The open/close members 63 can also move in a vertical direction. When the open/close members 63 are raised as the carriage 11 is moved to the aforementioned maintenance position, the open/close members 63 push up the bottoms of the valve elements 53 at their tops. Thereby, the valve elements 53 are raised against the biasing force of the spring 55 so as to open the exits of the air discharge passages 31.

The discharge tube 65 is opened inside the discharge cap 61 at an entrance side, and connected to a pump 67 at an exit side.

While the discharge cap 61 is raised to form the airtight space between the valve case 59 and the discharge cap 61, the open/close members 63 are raised to open the exits of the air discharge passages 31. When the pump 67 is operated at this point, air inside the air discharge passages 31 is discharged via the discharge tubes 65 so that a negative pressure is applied to the air discharge passages 31.

In the present embodiment, at least three open/close members 63 out of four open/close members 63 can only be operated simultaneously. One of the open/close members 63 can be operated independently from the other three. The three open/close members 63 which operate simultaneously correspond to the ink passages provided for ink of three colors, i.e., cyan, magenta and yellow. One of the open/close members 63 which can independently operate corresponds to the ink passage provided for black ink.

Constituted as above, the ink passages for color ink and the ink passage for black ink can be arbitrarily selected in combination. Thus, a negative pressure can be applied only to the air discharge passage(s) 31 corresponding to the selected ink passage(s).

1.3 Operation Flow of Air Removal Process

Hereinafter, an air removal process by the air removal device of the present embodiment is explained.

The air removal process is performed as a part of a maintenance process which is performed every time the multi function apparatus 1 performs image recording onto a predetermined number of recording sheets. The multi function apparatus 1 moves the carriage 11 to the maintenance position upon the maintenance process. Then, the following air removal process is performed.

When the air removal process is started, the multi function apparatus 1 firstly lowers the movable member 37 (S110). As noted above, the movable member 37 is at the first position (see FIG. 4B) except when the air removal process is performed. By the step of S110, the movable member 37 moves to the second position (see FIG. 4A).

Subsequently, the multi function apparatus 1 opens a valve (S120). Particularly, the discharge cap 61 is raised to be closely attached to the bottom of the valve case 59, so as to form an airtight space between the bottom surface of the valve case 59 and the inner surface of the discharge cap 61. Furthermore, the open/close member 63 is raised to push up the bottom of the valve element 53 at the top so as to raise the valve element 53 to open the valve.

Now, the multi function apparatus 1 operates the pump 67 (S130). Thereby, air inside the air discharge passage 31 is discharged via the discharge tube 65. A negative pressure is applied to the air discharge passage 31. Then, it is determined whether a predetermined time has passed after the operation of the pump 67 (S140). If the predetermined time has not passed (S140: NO), the process returns to S140. In this manner, after the operation of the pump 67 until the predetermined time has passed, the pump 67 is kept in operation.

As the operation of the pump 67 is continued, air is discharged from the ink chamber 23 to the air discharge passage 31, as shown in the arrow of FIG. 4A. Also, together with the discharge of air, the pressure inside the ink chamber 23 is decreased. Ink flows from the ink tube 17 into the ink chamber 23. Consequently, the ink surface is raised. When the ink surface reaches to the bottom of the movable member 37, the ink surface hereafter is raised only on the inner peripheral side of the movable member 37. On the outer peripheral side of the movable member 37, the rise of the ink surface stops at the same height with the bottom of the movable member 37. Air is left in the space 231 above the ink surface. The rise of the ink surface on the inner peripheral side of the movable member 37 continues until the ink surface reaches to the air permeable membrane 35. As a result, the space 232 on the inner peripheral side of the movable member is filled with ink.

The predetermined time to be a referred in the step of S140 is set to the time sufficient to fill the space 232 on the inner peripheral side of the movable member 37 with ink. Normally, after the space 232 on the inner peripheral side of the movable member 37 is filled with ink, it is determined that the predetermined time has passed in S140. When the predetermined time has passed (S140: YES), the multi function apparatus 1 stops the pump 67 (S150).

Subsequently, the multi function apparatus 1 closes the valve (S160). The valve is closed by lowering the open/close member 63 and pushing down the valve element 53 by the biasing force of the spring 55. At this time, the discharge cap 61 is also lowered to be separated from the bottom surface of the valve case 59.

Lastly, the multi function apparatus 1 raises the movable member 37 (S170). The movable member 37 which has been moved to the second position by the step of S110 now returns to the first position by the step of S170. When the movable member 37 is displaced to the first position, there is no longer a wall partitioning the air left on the outer peripheral side of the movable member 37 from the ink filled in the space 232 on the inner peripheral side of the movable member 37. Thus, the ink filling the space 232 on the inner peripheral side of the movable member 37 flows down. The air left on the outer peripheral side of the movable member 37 flows into the area which has been on the inner peripheral side of the movable member 37. As a result, the air flows in between the air permeable membrane 35 and the ink surface. Ink inside the ink chamber 23 is brought into a state separated from the air permeable membrane 35.

1.4 Effects

As is clear from the above, according to the above multi function apparatus 1, displacement of the movable member 37 from the second position to the first position can separate ink from the air permeable membrane 35. Accordingly, the performance of the air permeable membrane 35 can be maintained for a longer term than the case in which ink is left in contact with the air permeable membrane 36, Also, the multi function apparatus 1 includes the tubular body 33 which functions as a part of the air discharge passage 31. The movable member 37 is coaxially provided on the outer peripheral side of the tubular body 33. The air permeable membrane 35 is provided at the bottom of the tubular body 33. Therefore, compared to the case in which an air permeable membrane is provided inside the tubular member, the air permeable membrane 35 can be easily attached to the tubular body 33, there is less labor required for manufacturing, and the productivity is increased.

2 Second Embodiment

The second embodiment is explained hereafter. The second embodiment is different from the first embodiment only in the structure near the upstream end in the air discharge direction of the air discharge passage 31. Therefore, only the difference is explained in detail and explanation on the same points is not repeated, by giving the same referential number to the same portion as in the first embodiment.

2.1 Main Structure of Air Removal Device

Figure 7B:
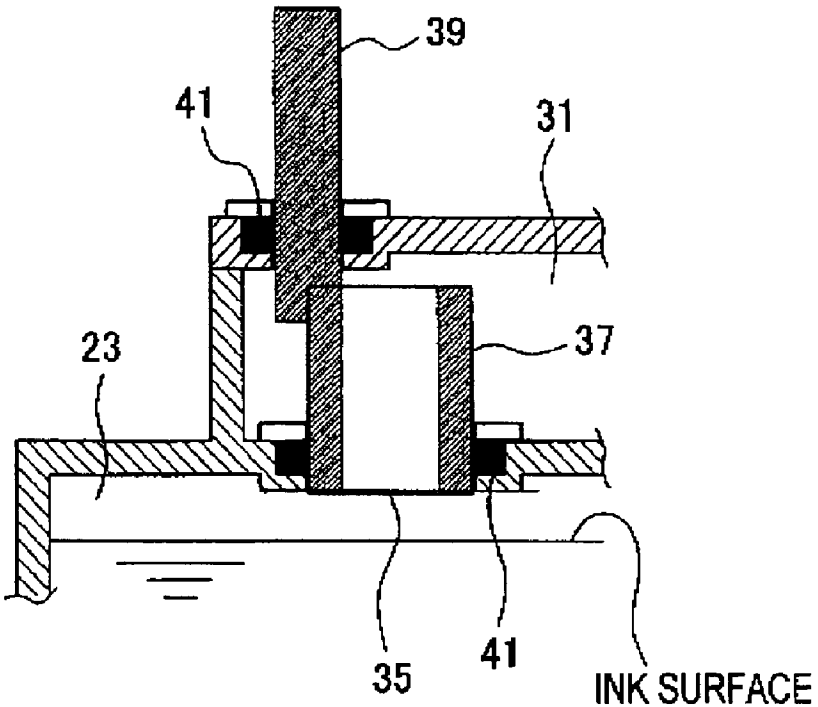
FIGS. 7A and 7B are longitudinal sectional views showing a structure of a movable member and the periphery according to a second embodiment.
Figure 7A:
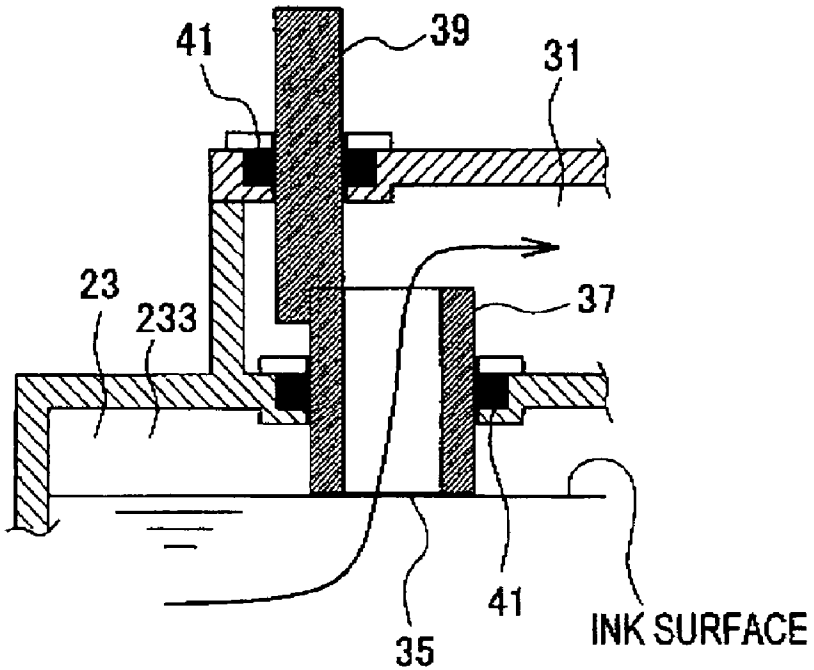

Referring to FIGS. 7A and 7B, the tubular movable member 37 is provided near the upstream end in the air discharge direction of the air discharge passage 31.

The movable member 37 is designed to move in a vertical direction. The movable member 37 is at a raised position (first position (see FIG. 7B)) except when air is discharged via the air discharge passage 3. The movable member 37 is displaced to a lowered position (second position (see FIG. 7A)) only when air is discharged via the air discharge passage 31. When the movable member 37 is displaced to the second position, the cavity serves as a part of the air discharge passage 31. The opening at the bottom of the movable member 37 serves as an entrance to the air discharge passage 31.

In the present embodiment, the air permeable membrane 35 which passes air but not ink is provided at the bottom of the movable member 37.

In short, the second embodiment is different from the first embodiment in that the tubular body 33 is not used and the air permeable membrane 35 is provided at the bottom of the movable member 37, In the above constitution as well, displacement of the movable member 37 to the second position and application of a negative pressure to the air discharge passage 31 allow discharge of air from the ink chamber 23 to the air discharge passage 31, as shown by an arrow of FIG. 7A. The discharge of air is terminated once the ink surface comes in contact with the air permeable membrane 35 at the bottom of the movable member 37, leaving the air in a space 233 on the outer peripheral side of the movable member 37. At this state, when the movable member 37 is displaced to the first position, the air on the outer peripheral side of the movable member 37 flows into the area which has been on the inner peripheral side of the movable member 37. This air flows in between the air permeable membrane 35 and the ink surface, as shown in FIG. 7B, to separate the ink inside the ink chamber 23 from the air permeable membrane 35.

2.2 Effects

As is clear from the above, even according to the second embodiment, displacement the movable member 37 from the second position to the first position can separate ink from the air permeable membrane 35. Accordingly, the performance of the air permeable membrane 35 can be maintained for a longer term than the case in which ink is left in contact with the air permeable membrane 35.

Particularly, in the second embodiment, the air permeable membrane 35 is lifted together with the rise of the movable member 37. As a result, while the volume on the air discharge passage 31 side is decreased, the volume on the ink chamber 23 side is increased. Accordingly, the inner pressure on the air discharge passage 31 side becomes higher than the inner pressure on the ink chamber 23 side by the volume changed. Air on the air discharge chamber 31 side passes through the air permeable membrane 35 to flow back to the ink chamber 23 side. Due to the air flowing back to the ink chamber 23 side, ink adhering to the air permeable membrane 35 is blown off. The present embodiment can reduce the amount of ink adhering to the air permeable membrane 35 better than the first embodiment. Accordingly, the performance of the air permeable membrane 35 can be maintained for a further longer term than the case in the first embodiment.

Also, in the second embodiment, the air permeable membrane 35 is provided at the bottom of the movable member 37. Therefore, compared to the case in which the air permeable membrane is provided inside the movable member, the air permeable membrane 35 can be easily attached to the movable member 37. There is less labor required for manufacturing, and the productivity is increased.

3 Third Embodiment

The third embodiment is explained hereafter. As to the third embodiment as well, only the difference from the first and the second embodiments is mainly explained and explanation on the same points is not repeated, giving the same referential number to the same portion as in the first embodiment.

3.1 Main Structure of Air Removal Device

Figure 8B:
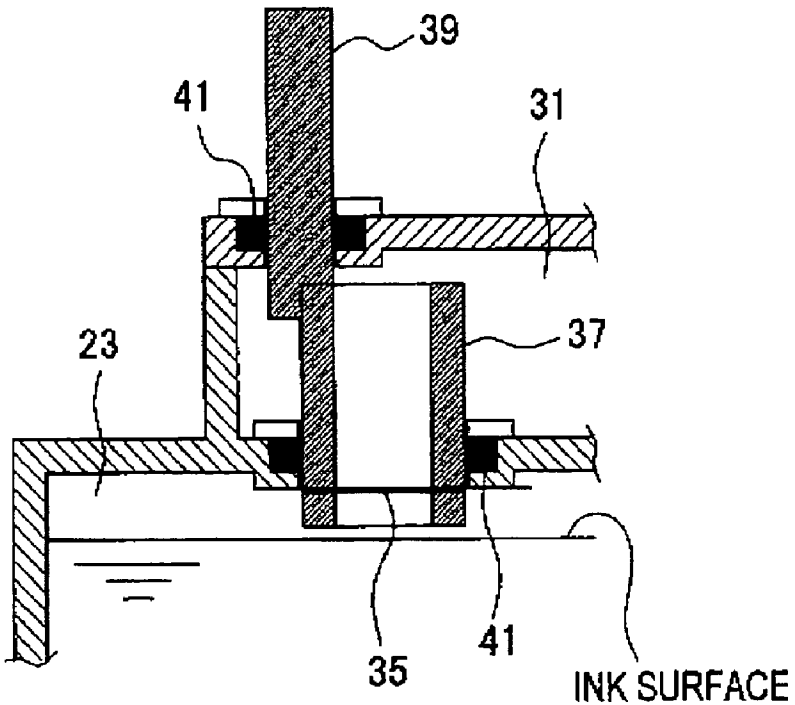
FIGS. 8A and 8B are longitudinal sectional views showing a structure of a movable member and the periphery according to a third embodiment.
Figure 8A:
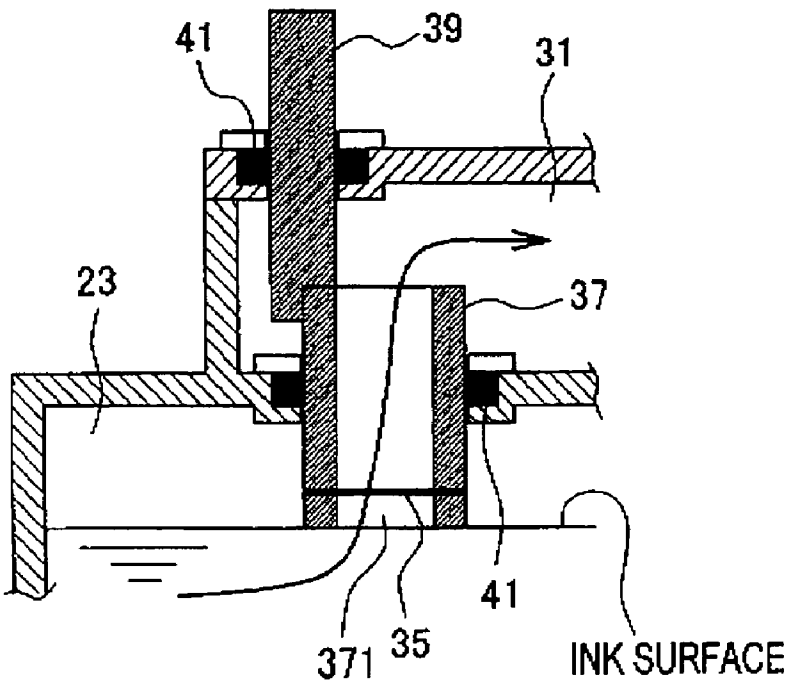

Referring to FIGS. 8A and 8B, the tubular movable member 37 is provided near the upstream end in the air discharge direction of the air discharge passage 31.

The movable member 37 is designed to move in a vertical direction. The movable member 37 is at a raised position (first position (see FIG. 8B)) except when air is discharged via the air discharge passage 3. The movable member 37 is displaced to a lowered position (second position (see FIG. 8A)) only when air is discharged via the air discharge passage 31. When the movable member 37 is displaced to the second position, the cavity functions as a part of the air discharge passage 31. The opening at the bottom of the movable member 37 functions as an entrance to the air discharge passage 31.

In the present embodiment, the air permeable membrane 35 which passes air but not ink is provided inside the cavity of the movable member 37.

In short, the third embodiment is only different from the second embodiment in that the air permeable membrane 35 is provided inside the cavity 371 of the movable member 37.

In the above constitution as well, displacement of the movable member 37 to the second position and application of a negative pressure to the air discharge passage 31 allow discharge of air from the ink chamber 23 to the air discharge passage 31, as shown by an arrow of FIG. 8A. The discharge of air is terminated once the ink surface comes in contact with the air permeable membrane 35 inside the cavity 371 of the movable member 37, leaving the air in a space on the outer peripheral side of the movable member 37. At this state, when the movable member 37 is displaced to the first position, the air on the outer peripheral side of the movable member 37 flows into the area which has been on the inner peripheral side of the movable member 37. This air flows in between the air permeable membrane 35 and the ink surface, as shown in FIG. 5B, to separate the ink inside the ink chamber 23 from the air permeable membrane 35.

3.2 Effects

As is clear from the above, even according to the third embodiment, displacement of the movable member 37 from the second position to the first position can separate ink from the air permeable membrane 35. Accordingly, the performance of the air permeable membrane 35 can be maintained for a longer term than the case in which ink is left in contact with the air permeable membrane 35.

In the third embodiment as well as in the second embodiment, the air permeable membrane 35 is lifted together with the rise of the movable member 37. Consequently, while the volume on the air discharge passage 31 side is decreased, the volume on the ink chamber 23 side is increased. Accordingly, the inner pressure on the air discharge passage 31 side becomes higher than the inner pressure on the ink chamber 23 side by the volume changed. Air on the air discharge chamber 31 side passes through the air permeable membrane 35 to flow back to the ink chamber 23 side. Due to the air flowing back to the ink chamber 23 side, ink adhering to the air permeable membrane 35 is blown off. The present embodiment can reduce the amount of ink adhering to the air permeable membrane 35 better than the first embodiment. Accordingly, the performance of the air permeable membrane 35 can be maintained for a further longer term than the case in the first embodiment.

Also, in the third embodiment, the air permeable membrane 35 is provided inside the cavity of the movable member 37. Therefore, the present embodiment is convenient when it is not desirable to provide an air permeable membrane at the bottom for some reasons.

4 Fourth Embodiment

The fourth embodiment is explained hereafter. As to the fourth embodiment as well, only the difference from the first to third embodiments is mainly explained and explanation on the same points is not repeated, giving the same referential number to the same portion as in the first embodiment.

4.1 Main Structure of Air Removal Device

Figure 9B:
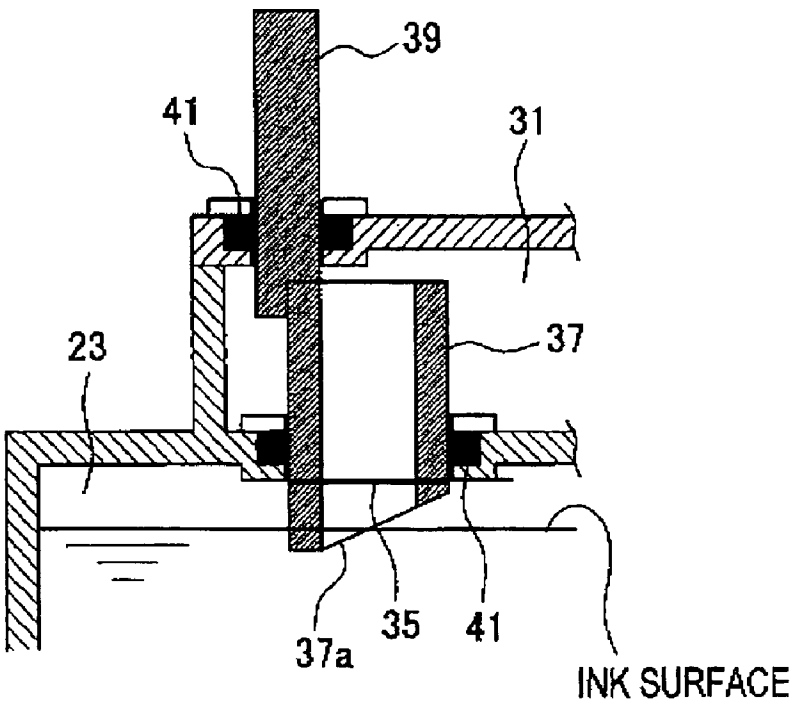
FIGS. 9A and 9B are longitudinal sectional views showing a structure of a movable member and the periphery according to a fourth embodiment.
Figure 9A:
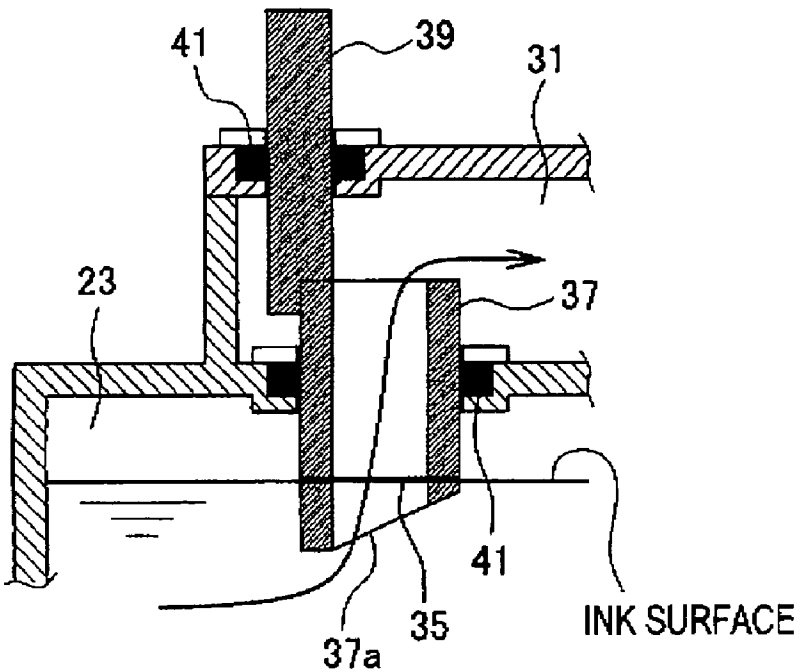

Referring to FIGS. 9A and 9B, the tubular movable member 37 is provided near the upstream end in the air discharge direction of the air discharge passage 31.

The movable member 37 is designed to move in a vertical direction. The movable member 37 is at a raised position (first position (see FIG. 9B)) except when air is discharged via the air discharge passage 3. The movable member 37 is displaced to a lowered position (second position (see FIG. 9A)) only when air is discharged via the air discharge passage 31. When the movable member 37 is displaced to the second position, the cavity functions as a part of the air discharge passage 31. The opening at the bottom of the movable member 37 functions as an entrance to the air discharge passage 31.

In the present embodiment, the air permeable membrane 35 which passes air but not ink is provided inside the cavity of the movable member 37.

The fourth embodiment is only different from the third embodiment in that a bottom surface 37*a* of the movable member 37 is a slant surface 37*a* which is cut at a slant below the air permeable membrane 35 with respect to a horizontal plane.

In the above constitution as well, displacement of the movable member 37 to the second position and application of a negative pressure to the air discharge passage 31 allow discharge of air from the ink chamber 23 to the air discharge passage 31, as shown by an arrow of FIG. 9A. The discharge of air is terminated once the ink surface comes in contact with the air permeable membrane 35 inside the cavity of the movable member 37, leaving the air in a space on the outer peripheral side of the movable member 37. At this state, when the movable member 37 is displaced to the first position, the air on the outer peripheral side of the movable member 37 flows into the area which has been on the inner peripheral side of the movable member 37. This air flows in between the air permeable membrane 35 and the ink surface, as shown in FIG. 9B, to separate the ink inside the ink chamber 23 from the air permeable membrane 35.

4.2 Effects

As is clear from the above, even according to the fourth embodiment, displacement of the movable member 37 from the second position to the first position can separate ink from the air permeable membrane 35. Accordingly, the performance of the air permeable membrane 35 can be maintained for a longer term than the case in which ink is left in contact with the air permeable membrane 35, In the fourth embodiment as well as the second and the third embodiments, the air permeable membrane 35 is lifted together with the rise of the movable member 37. Consequently, while the volume on the air discharge passage 31 side is decreased, the volume on the ink chamber 23 side is increased. Accordingly, the inner pressure on the air discharge passage 31 side becomes higher than the inner pressure on the ink chamber 23 side by the volume changed. Air on the air discharge chamber 31 side passes through the air permeable membrane 35 to flow back to the ink chamber 23 side. Due to the air flowing back to the ink chamber 23 side, ink adhering to the air permeable membrane 35 is blown off. The present embodiment can reduce the amount of ink adhering to the air permeable membrane 35 better than the first embodiment. Accordingly, the performance of the air permeable membrane 35 can be maintained for a further longer term than the case in the first embodiment.

Also, in the fourth embodiment, the bottom surface 37*a* of the movable member 37 is cut at a slant below the air permeable membrane 35 with respect to the horizontal plane. Accordingly, when the movable member 37 is raised from the second position to the first position, there is a state in which a part of the bottom end surface 37*a* (left part of the bottom surface 87*a* in FIG. 9B) is still in contact with ink inside the ink chamber 23 while another part (right part of the bottom surface 37*a* in FIG. 9B) is separated from the ink inside the ink chamber 23. As the air flows into the inner peripheral side of the movable member 37 from the separated portion, ink adhering near the air permeable membrane 35 runs down to the portion (left part of the bottom surface 37*a* in FIG. 9B) leading to the ink retained below. Accordingly, compared to the case in which the whole bottom surface of the movable member 37 is separated from ink at a time (bottom surface is horizontal), it is difficult for ink drops to stay on the bottom of the movable member 37. Little ink is left on the movable member 37.

Particularly, in the fourth embodiment, the bottom of the movable member 37 is partially left in contact with ink inside the ink chamber 23, as shown in FIG. 9B, even after the movable member 37 is displaced from the first position to the second position. Therefore, even if the ink adhering near the air permeable membrane 35 has high viscosity, the ink can eventually run down to the portion which is left in contact with ink retained below. Accordingly, compared to the case in which the movable member 37 is completely separated from the ink retained below, it is further difficult for ink drops to stay on the bottom of the movable member 37.

5 Fifth Embodiment

The fifth embodiment is explained hereafter. As to the fifth embodiment as well, only the difference from the first to fourth embodiments is mainly explained and explanation on the same points is not repeated, giving the same referential number to the same portion as in the first embodiment.

5.1 Main Structure of Air Removal Device

Figure 10B:
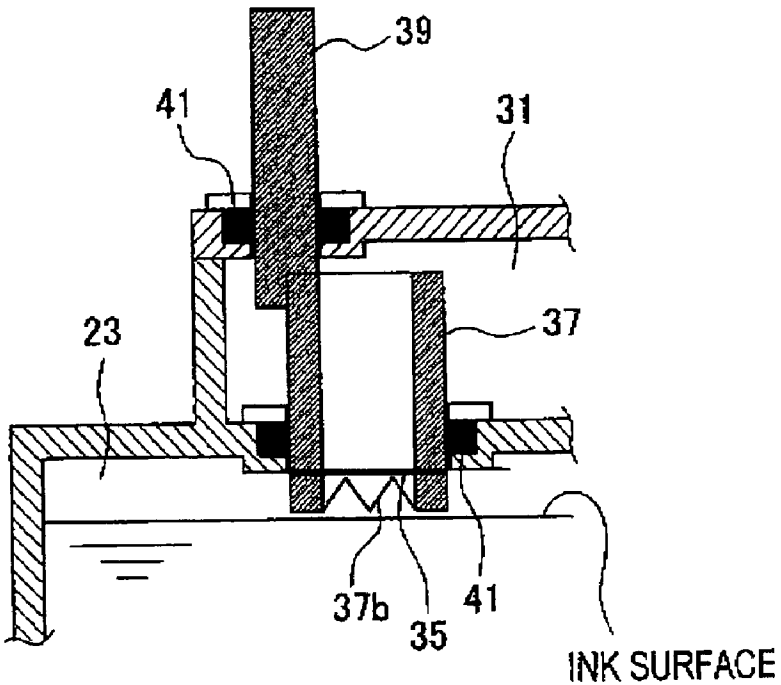
FIGS. 10A and 10B are longitudinal sectional views showing a structure of a movable member and the periphery according to a fifth embodiment.
Figure 10A:
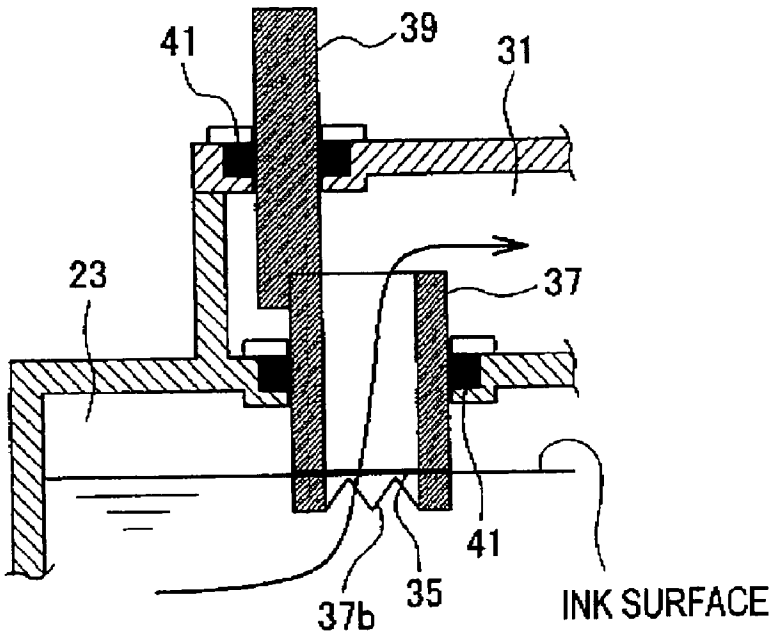

Referring to FIGS. 10A and 10B, the tubular movable member 37 is provided near the upstream end in the air discharge direction of the air discharge passage 31.

The movable member 37 is designed to move in a vertical direction. The movable member 37 is at a raised position (first position (see FIG. 10B)) except when air is discharged via the air discharge passage 3. The movable member 37 is displaced to a lowered position (second position (see FIG. 10A)) only when air is discharge via the air discharge passage 31. When the movable member 37 is displaced to the second position, the cavity functions as a part of the air discharge passage 31. The opening at the bottom of the movable member 37 functions as an entrance to the air discharge passage 31.

In the present embodiment, the air permeable membrane 35 which passes air but not ink is provided inside the cavity of the movable member 37.

The fifth embodiment is only different from the fourth embodiment in that a bottom surface 37*a* of the movable member 37 is a surface which is cut zigzag below the air permeable membrane 35 (surface with a plurality of downward protrusions in the form of triangle in a side view).

In the above constitution as well, displacement of the movable member 37 to the second position and application of a negative pressure to the air discharge passage 31 allow discharge of air from the ink chamber 23 to the air discharge passage 31, as shown by an arrow of FIG. 10A. The discharge of air is terminated once the ink surface comes in contact with the air permeable membrane 35 inside the cavity of the movable member 37, leaving the air in a space on the outer peripheral side of the movable member 37. At this state, when the movable member 37 is displaced to the first position, the air on the outer peripheral side of the movable member 37 flows into the area which has been on the inner peripheral side of the movable member 37. This air flows in between the air permeable membrane 35 and the ink surface, as shown in FIG. 10, to separate the ink inside the ink chamber 23 from the air permeable membrane 35.

5.2 Effects

As is clear from the above, even according to the fifth embodiment, displacement of the movable member 87 from the second position to the first position ink can separate ink from the air permeable membrane 35. Accordingly, the performance of the air permeable membrane 35 can be maintained for a longer term than the case in which ink is left in contact with the air permeable membrane 35.

In the fifth embodiment as well as the second to the fourth embodiments, the air permeable membrane 35 is lifted together with the rise of the movable member 37. Consequently, while the volume on the air discharge passage 31 side is decreased, the volume on the ink chamber 23 side is increased. Accordingly, the inner pressure on the air discharge passage 31 side becomes higher than the inner pressure on the ink chamber 23 side by the volume changed. Air on the air discharge chamber 31 side passes through the air permeable membrane 35 to flow back to the ink chamber 23 side. Due to the air flowing back to the ink chamber 23 side, ink adhering to the air permeable membrane 35 is blown off. The present embodiment can reduce the amount of ink adhering to the air permeable membrane 35 better than the first embodiment. Accordingly, the performance of the air permeable membrane 35 can be maintained for a further longer term than the case in the first embodiment.

Also, in the fifth embodiment, the bottom surface 37*b* of the movable member 37 is cut zigzag (with a plurality of downward protrusions in the form of triangle in a side view) below the air permeable membrane 35. Accordingly, when the movable member 37 is raised from the second position to the first position, there is a state in which parts of the bottom end surface 37*b* (portions protruding downward) are in contact with ink inside the ink chamber 23 while another parts (portions concave upward) are separated from the ink inside the ink chamber 23. As air flows into the inner peripheral side of the movable member 37 from the separated portion, ink adhering near the air permeable membrane 35 runs down to the portions (portions protruding downward) leading to ink retained below. Accordingly, compared to the case in which the whole bottom surface of the movable member 37 is separated from ink at a time (bottom surface is horizontal), it is difficult for ink drops to stay on the bottom of the movable member 37. Little ink is left on the movable member 37.

6 Other Embodiments

The embodiments of the present invention are explained above. However, the present invention should not be limited to the above embodiments and can be practiced in various manners.

In the above embodiments, the movable member 37 moves in a vertical direction to introduce air from the outer peripheral side to the inner peripheral side of the movable member 37. In this manner, the air permeable membrane 35 is separated from the ink surface. However, the moving direction of the movable member is not limited to the vertical direction.

For example, an external tube may be provided on the outer periphery of an internal tube. A slit is provided on each of the internal and the external tubes. The internal or the external tube is rotated on an axis such that the two slits do not overlap. In that state, the internal tube is made to function as an entrance to the air discharge passage 31. After the discharge of air, the internal or the external tube is rotated until the two slits overlap with each other. Air is introduced into the inner part of the internal tube via the slits and separates the air permeable membrane 35 inside the cavity of the internal tube from the ink surface, Such a constitution can implement the characteristic structure of the present invention by rotating the internal or the external tube around the axis. There is no need to move the internal and/or the external tube in a vertical direction.

Also in the above embodiments, a negative pressure is applied to the air discharge passage 31 using the pump 67 to discharge air from the ink chamber 23 to the air discharge passage 31. However, a pump which can supply ink at high pressure may be provided inside the ink chamber 23. Then, application of a positive pressure to the ink chamber 23 side can permit air to be discharged from the ink chamber 23 to the air discharge passage 31.

Furthermore, in the present embodiments, one or both of the three ink passages for color ink and the ink passage for black ink are arbitrarily selected. A negative pressure can be applied to the air discharge passage(s) 31 corresponding to the selected ink passage(s). However, the three ink passages for color ink may be designed to be independently selected. That is, in the above embodiments, three out of the four valve elements 53 corresponding to the three ink passages for color ink are designed to open/close at the same time. However, the four valve elements 53 may be designed to independently open/close.

To simplify the structure, the ink passages for color ink and black ink may be treated in the same manner. That is, all the four valve elements 53 may be designed to open/close at a time.

Also in the above embodiments, the total number of colors of ink is assumed to be four. However, one, six or eight colors of ink may be used. In this case, the air removal device of the present invention may be provided per color, Additionally in the present embodiments, the tubular body 33 and/or the tubular movable member 37 are assumed to have a shape of cylinder. However, not only the cylinder body which appears to be round in an axially vertical cross section, but also a tubular body which appears to be oval or in other forms, e.g., polygonal shapes, in a axially vertical cross section is acceptable. However, in consideration of sealing with a sealing member, it is preferable that the tubular body has a round or oval form in the axially vertical cross section.

What is claimed is:

1. An air removal device for ink supply mechanism comprises:

an ink chamber that is provided in an ink passage from an ink supply source to a recording head;

an air discharge passage that is provided to discharge, out of the ink chamber, air flowing into the ink chamber with ink and collected therein;

an air permeable membrane that is provided at an entrance or inside of the air discharge passage to pass air but not ink;

a pump that applies a positive pressure to the ink chamber side or a negative pressure to the air discharge passage side in order to discharge air via the air discharge passage; and a movable member having an internal cavity functioning as a part of the air discharge passage and being displaced between a first position and a second position, the first position being chosen except when air is discharged via the air discharge passage and the second position being chosen when air is discharged via the air discharge passage, wherein when the movable member is displaced to the second position to operate the pump, air is discharged from the ink chamber to the air discharge passage, and the ink inside the ink chamber is brought into contact with the air permeable membrane while air is still left in a portion of space inside the ink chamber, and when the pump is then stopped and the movable member is displaced to the first position, one or both of air left in the portion of space and air present downstream in an air discharge direction of the air permeable membrane flows in between the air permeable membrane and the ink inside the ink chamber, so that the ink inside the ink chamber is separated from the air permeable membrane.

2. The air removal device for ink supply mechanism according to claim 1, wherein the internal cavity of the movable member extends in a vertical direction, an opening provided at a bottom of the movable member functions as an entrance to the air discharge passage, the movable member is designed to move in a vertical direction, a raised position being the first position and a lowered position being the second position.

3. The air removal device for ink supply mechanism according to claim 2, wherein the air permeable membrane is provided at the bottom of the movable member.

4. The air removal device for ink supply mechanism according to claim 2, wherein the air permeable membrane is provided inside the cavity of the movable member.

5. The air removal device for ink supply mechanism according to claim 2, further comprising a tubular body that functions as a part of the air discharge passage, wherein the movable member is coaxially disposed on an outer peripheral side of the tubular body, and the air permeable membrane is provided at a bottom of the tubular body.

6. The air removal device for ink supply mechanism according to claim 2, wherein the bottom of the movable member is shaped such that, when displacing the movable member from the first to the second position, a part of the bottom of the movable member is in contact with the ink inside the ink chamber while another part is separated from the ink inside the ink chamber.

7. The air removal device for ink supply mechanism according to claim 6, wherein the bottom of the movable member is cut at a slant.

8. The air removal device for ink supply mechanism according to claim 6, wherein the bottom of the movable member is cut zigzag.

9. An ink-jet printer comprising the ink supply mechanism according to claim 8.

10. The air removal device for ink supply mechanism according to claim 6, wherein a part of the bottom of the movable member is left in contact with the ink inside the ink chamber at the time when the movable member has changed its position from the second to the first position.

11. An ink supply mechanism comprising the air removal device for ink supply mechanism according to claim 1.

12. A method of removing air from an ink supply mechanism which includes: an ink chamber that is provided in an ink passage from an ink supply source to a recording head; an air discharge passage that is provided to discharge, out of the ink chamber, air flowing into the ink chamber with ink and collected therein; an air permeable membrane that is provided at an entrance or inside of the air discharge passage to pass air but not ink; a pump that applies a positive pressure to the ink chamber side or a negative pressure to the air discharge passage side in order to discharge air via the air discharge passage; and a movable member having an internal cavity functioning as a part of the air discharge passage and being displaced between a first position and a second position, the first position being chosen except when air is discharged via the air discharge passage and the second position being chosen when air is discharged via the air discharge passage, the method comprising the steps of:

when the movable member is displaced to the second position to operate the pump, discharging air from the ink chamber to the air discharge passage and bringing the ink inside the ink chamber into contact with the air permeable membrane while air is still left in a portion of space inside the ink chamber, and, when the pump is then stopped and the movable member is displaced to the first position, letting one or both of air left in the portion of space and air present downstream in an air discharge direction of the air permeable membrane flow in between the air permeable membrane and the ink inside the ink chamber, so that the ink inside the ink chamber is separated from the air permeable membrane.

* * * * *